US006445136B1

(12) United States Patent
Cheng

(10) Patent No.: US 6,445,136 B1
(45) Date of Patent: Sep. 3, 2002

(54) TWIN-BULB CHRISTMAS LIGHT BULB STRING

(76) Inventor: Hung Huei Cheng, No. 60, Lane 68, Na Chung Street, Hsinchu (TW)

( * ) Notice: Subject to any disclaimer, the term of this patent is extended or adjusted under 35 U.S.C. 154(b) by 0 days.

(21) Appl. No.: 09/776,840

(22) Filed: Feb. 6, 2001

(51) Int. Cl.[7] ..... H05B 37/00

(52) U.S. Cl. ..... 315/185 S; 362/252; 362/227; 362/396; 362/806

(58) Field of Search ..... 315/185 S, 185 R, 315/200 A; 362/227, 252, 800, 806

(56) References Cited

U.S. PATENT DOCUMENTS 5,779,352 A * 7/1998 Lin ..... 362/249
5,839,820 A * 11/1998 Huang ..... 362/252
5,988,831 A * 11/1999 Pan ..... 362/227
6,265,834 B1 * 7/2001 Lin ..... 315/185 S

* cited by examiner

*Primary Examiner*—Don Wong
*Assistant Examiner*—Tuyet T. Vo
(74) *Attorney, Agent, or Firm*—Rosenberg, Klein & Lee

(57) ABSTRACT

The present invention relates to a twin-bulb Christmas light bulb string of a curtain-type light bulb string. It mainly combines every two bulb-assemblies at a same level on the branch string to become a twin-bulb single body by a loop or the like for providing a special and different decorative effect. This obtains improvement and utility.

4 Claims, 2 Drawing Sheets

TWIN-BULB CHRISTMAS LIGHT BULB STRING

BACKGROUND OF THE INVENTION

A conventional curtain-type decorative bulb string includes a main electrical wire with several parallel branch strings. The said branch string has an extended electrical wire being provided with several bulb assemblies in interval for lighting effect. Each bulb assembly is positioned singly and the lighting effect of this prior known curtain-type string would be not enough for decoration.

Accordingly, the primary object of the invention is to provide an improved curtain-type Christmas light bulb string with twin-bulb provided on the branch electrical wire to obtain a different decorative effect and to increase the utility. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
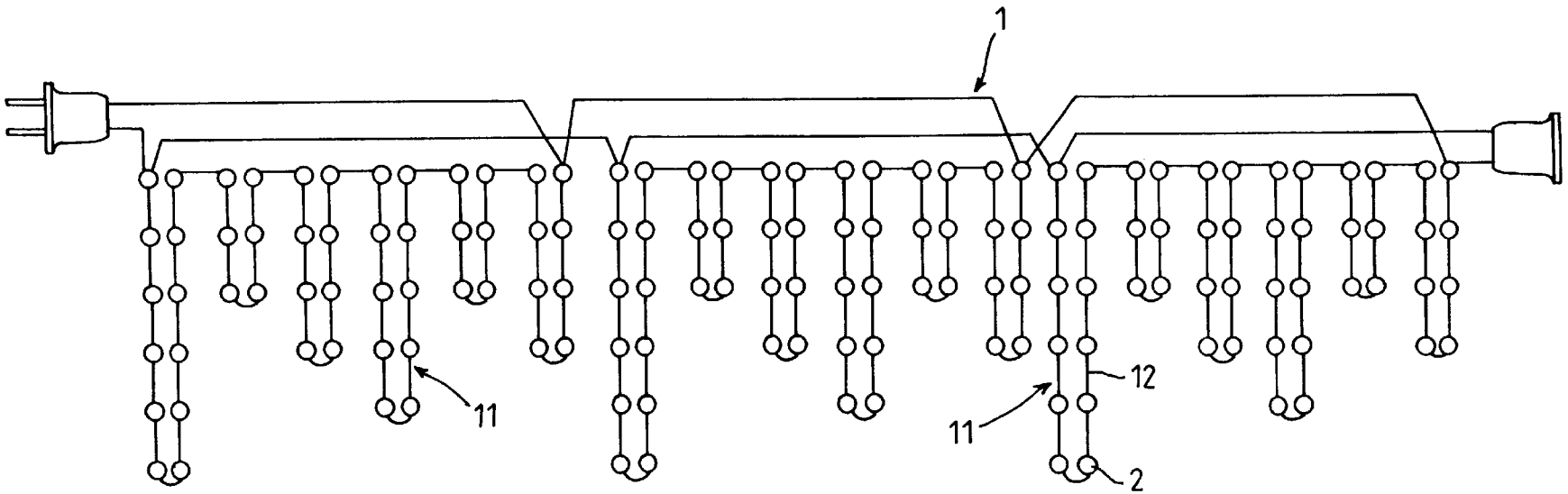
FIG. 1 is a plan view showing a twin-bulb Christmas light bulb string according to the present invention.
Figure 2:
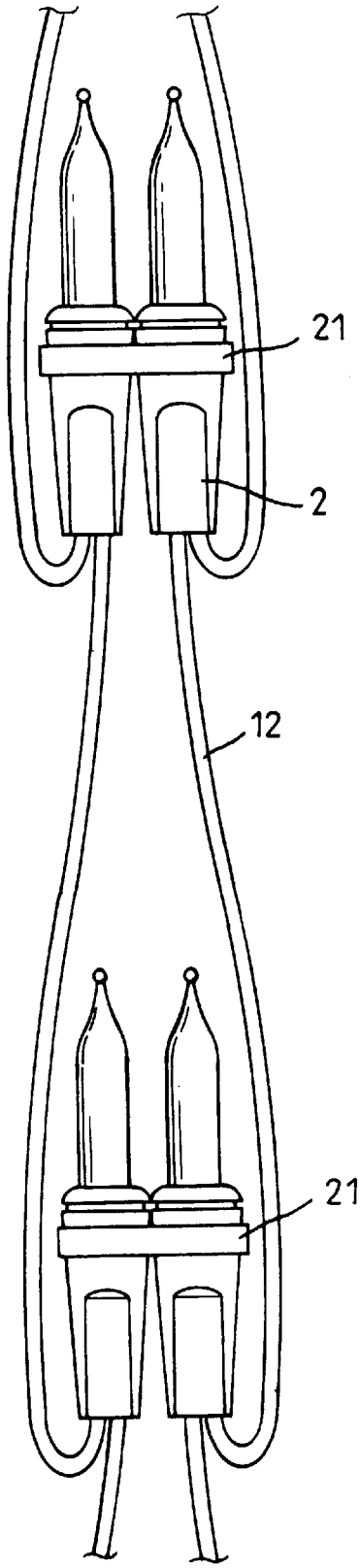
FIG. 2 is a perspective view showing parts of the twin-bulb on the branch electrical wire according to the present invention.

Referring to the affixed drawings, the present invention is to provide an improved curtain-type light bulb string, which includes a main electrical wire (1) with several parallel branch strings (11). Each branch string (11) has an extended electrical wire (12) with a plurality of bulb assembly (2) being positioned in interval. The characteristic of the present invention is that every two of the bulb assembly (2) at a same level on the branch string (11) can be combined by a loop (21) to become a twin-bulb structure as a single body while the branch string is equally folded. It is completed a curtain-type Christmas light bulb string with twin-bulb decoration.

After the above assembly, the twin-bulb structure on each branch string of the present invention will provide a better lighting effect. The structure of the twin-bulb also increases the lighting decoration and is absolutely novel. Thus it has excellent practical value in the field. Evidently the invention has the essence of a patent. We hereby apply for a patent grant.

Moreover, the above structure is only an exemplary according to the present invention. Any simple modification under the spirit of this invention, such as increasing the number of the combined bulbs or combining the bulbs by winding the electrical wire instead of using the loop, will be claimed in this application.

What is claimed is:

1. A twin-bulb Christmas light bulb string providing a light curtain aesthetic effect comprising:

(a) a main electrical lead and a secondary electrical lead electrically coupled to a power supply;

(b) a first plurality of bulb assembly sets, each of said first bulb assembly sets in vertically aligned relation with respect to a next succeeding first bulb assembly set, each of said first bulb assembly sets including at least two bulb members being coupled respectively to a next succeeding bulb member forming a next succeeding first bulb assembly set through said main electrical lead and said secondary electrical lead;

(c) a loop member extending around said bulb members defining a bulb assembly set for coupling said bulb members each to the other.

2. The twin-bulb Christmas light bulb string as recited in claim 1 where said loop member couples said bulb members in a side-by-side horizontal location providing a twin-bulb aesthetic effect.

3. The twin-bulb Christmas light bulb string as recited in claim 1 including at least a second plurality of bulb assembly sets horizontally displaced from said first plurality of bulb assembly sets and electrically coupled thereto for providing a light curtain effect, each of said second plurality of bulb assembly sets including at least two bulb members coupled to a next succeeding bulb member forming a next succeeding second bulb assembly set.

4. The twin-bulb Christmas light bulb string as recited in claim 3 wherein each of said at least two bulb-members are coupled to each other by said loop member in a side-by-side relation.

* * * * *